United States Patent [19]

Jurich, III

[11] 4,229,896

[45] Oct. 28, 1980

[54] RAPID LOADING DEVICE FOR A REVOLVER

[76] Inventor: Mike Jurich, III, 221 28th Pl., Manhattan Beach, Calif. 90266

[21] Appl. No.: 10,170

[22] Filed: Feb. 7, 1979

[51] Int. Cl.[3] ..... F42B 39/04

[52] U.S. Cl. ..... 42/89

[58] Field of Search ..... 42/89

[56] References Cited

U.S. PATENT DOCUMENTS

| | | | |
|---|---|---|---|
| 223,100 | 12/1879 | Bell | 42/89 |
| 1,929,440 | 10/1933 | Miano | 42/89 |
| 2,399,904 | 5/1946 | Baucum | 42/89 |
| 2,944,359 | 7/1960 | Hanley | 42/89 |
| 3,197,907 | 8/1965 | Olson | 42/89 |
| 3,541,716 | 11/1970 | Fordham et al. | 42/89 |
| 3,722,125 | 3/1973 | Switzer | 42/89 |
| 4,065,868 | 1/1978 | Johnson | 42/89 |

FOREIGN PATENT DOCUMENTS

| | | | |
|---|---|---|---|
| 387041 | 2/1933 | United Kingdom | 42/89 |

*Primary Examiner*—Charles T. Jordan

*Attorney, Agent, or Firm*—W. Edward Johansen

[57] ABSTRACT

A rapid loading device for revolvers which provides releasable securement of cartridges in condition for simultaneous loading of the cartridges into the cylinder chambers of the revolver. The device includes a first cylindrical member having an open end and a closed end which forms its base and a first disc having a center bore and a plurality of axially extending, radially distributed cartridge-receiving bores adapted to align with and introduce the cartridges into the cylinder chambers of the revolver. The first disc is disposed within the first cylindrical member and is mechanically coupled to the inner sidewall thereof. The device also includes a star sprocket whose lateral projections releasably lock each cartridge flange while laterally supporting each cartridge in conjunction with the first disc and a mechanism for releasing the star sprocket system in order to release the cartridges when the cartridge ends are in the cylinder chambers of the revolver. The mechanism includes a second cylindrical member which fits concentrically within the first cylindrical member and which has an open end which is adjacent to the open end of the first cylindrical member and a closed end which has a plurality of bores which are aligned with the bores of the first disc, a spring means for resiliently biasing the second cylindrical members in relation to the first cylindrical member and a coupling device for rotating the star sprocket in response to the second cylindrical member being pressed into the first cylindrical member.

5 Claims, 5 Drawing Figures

Fig. 1.
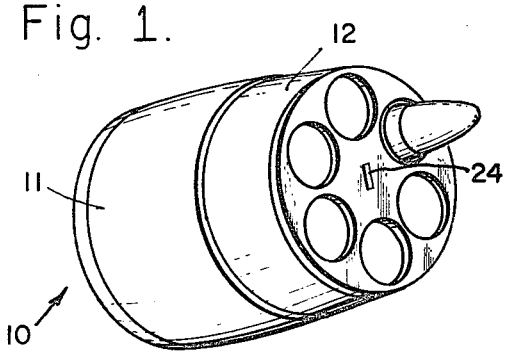
Fig. 2.
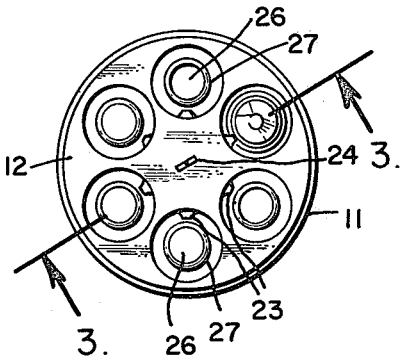
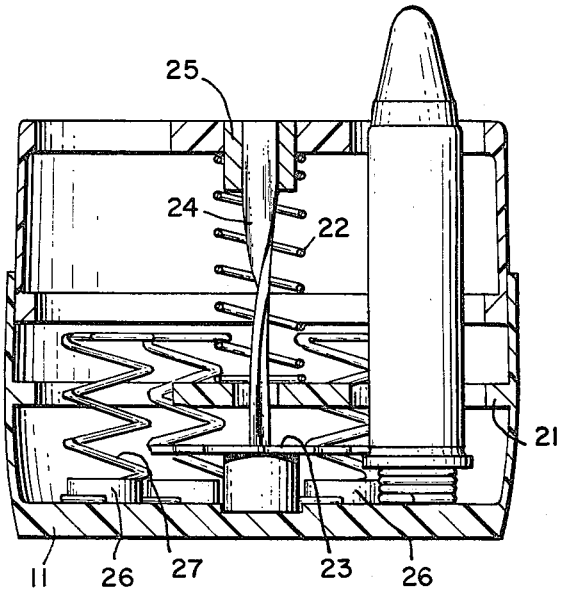
Fig. 3.
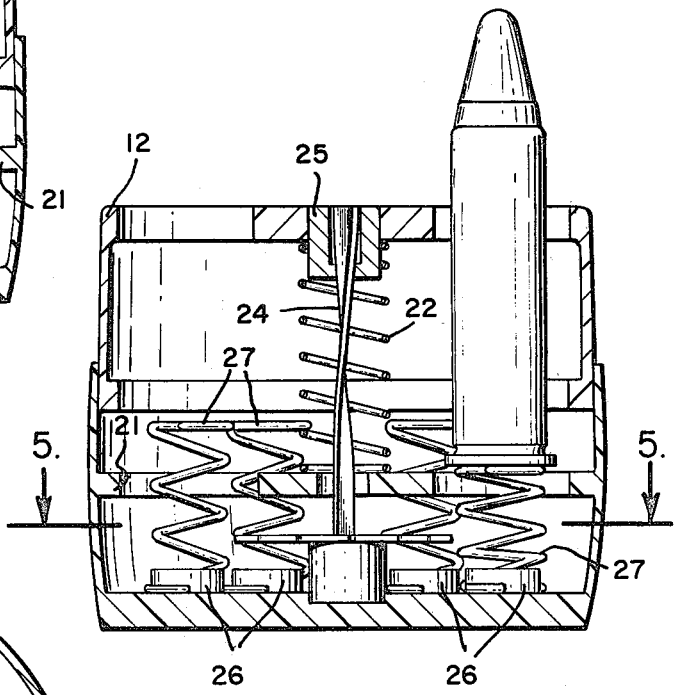
Fig. 4.
Fig. 5.
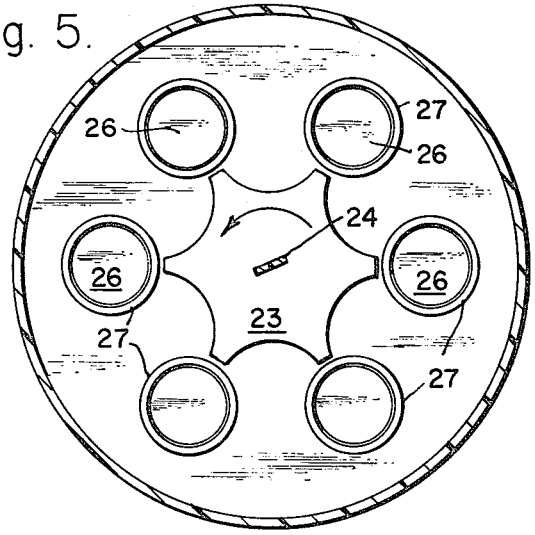

RAPID LOADING DEVICE FOR A REVOLVER

BACKGROUND OF THE INVENTION

1. Field of the Invention

The present invention relates to a rapid loading device for a revolver whereby a full complement of cartridges may be simultaneously loaded into the cylinder chambers of a revolver, and more particularly to a rapid loading device which may be loaded with only one hand.

2. Description of the Prior Art

Various devices of this type have been developed without a great measure of success because it is extremely important that the device be foolproof and positive in its operation because the life of the user may depend on its operation. As a loading device of this type must be manually pre-loaded, some type of holding means must be incorporated in its structure to hold the cartridges therein until they are released during the loading or reloading of a revolver. Therefore, a holding means as well as a release means are common to most devices of this nature; and the release means generally requires the application of a manual force directed axially inwardly or outwardly in some manner. One of the factors contributing to the unreliability of devices of this type has been that the release force, when applied in haste, very often may be directed off center or in some manner so as to cause one or more of the cartridges to become misaligned or cocked in the loading device, and as these loading devices generally depend on the forces of gravity to carry the cartridges into the revolver cylinder chambers after being released by the loading means, this often results in one or more of the cylinder chambers not receiving a cartridge, because, the moment the release force is relaxed by the user, the holding means will generally re-engage any cartridges which did not immediately fall into a chamber of the revolver cylinder.

U.S. Pat. No. 3,541,716, entitled Rapid Revolver Loader, issued to John Dees Fordham and William Lee Powers on Nov. 24, 1970, teaches a device for the rapid loading of a full complement of cartridges into the loading chambers of the cylinder of a revolver at one time. The device includes a first cylindrical body which provides a plurality of cartridge receiving chambers which are spaced to register with the loading chambers in the revolver, each chamber of the device being adapted to receive and temporarily captivate a cartridge therein until released in a loading operation. The device also includes a second cylindrical body for coaxial reciprocal, telescopic movement in the cartridge receiving chambers to dislodge the full complement of cartridges at one time by releasing a holding mechanism in the chambers and to provide a substantial, positive, longitudinal movement to all of said cartridges simultaneously in the cylindrical chambers. The holding mechanism includes a single O-ring set in an annular groove, which partially spans each of the cylindrical chambers to define a pocket to receive the flange portion of a cartridge yieldable so that the cartridge can pass the O-ring in loading the device and in loading a revolver with the device by displacement of said O-ring portion rapidly outwardly.

Initial efforts to develop a quick reload device for revolvers antedate the present invention by many decades, as evidenced by the disclosure in 1879 of Bell U.S. Pat. No. 223,100, and have continued periodically up to the present year. Such activity has been stimulated by police officers and the like who have insisted that such a device be foolproof and positive in its operation because their lives may at any moment depend upon its operation.

As a loading device of this type must be manually preloaded, some type of holding means must be incorporated in its structure to hold the cartridges therein until they are released during the loading or reloading of the revolver. Therefore, a holding means as well as release means are common to devices of this nature; and the release generally requires the application of a force directed inwardly or outwardly in some manner. Devices developed prior to the present invention have failed to satisfactorily resolve problems associated with the hold and release mechanisms.

One factor which precluded satisfactory operation of earlier devices was the failure to guard against premature release. The plural cartridge holders of Baucum U.S. Pat. No. 2,399,904, Hanley U.S. Pat. No. 2,944,359, and Olson U.S. Pat. No. 3,197,907, for example, are all especially subject to accidental release of one or more cartridges by the accidental application of pressure to the release mechanism. Baucum attempts to minimize the occasions of premature release by providing special carrying containers for his cartridge holder; however, unless care is exercised from the time immediately preceding installation into the container, and from the time following removal from the container up to insertion in the revolver's chambers, accidental release can still occur.

The earlier Bell device provides a potential solution to the accidental release problem by employing unitary construction, in that the cartridge holder's cartridge-receiving chambers and the locking mechanism are one solid piece and, hence, the release can be obtained only by holding the cartridges while the holder is rotated. It will be seen that this is a combination of events which is unlikely to occur inadvertently. However, this solution is purchased with unitary construction which presents other severe problems, e.g. biasing means accentuates a cartridge tilt problem hereinafter more fully described, and some potential for premature release remains.

Another factor that precludes satisfactory operation of earlier devices is that when the release force is applied in haste, it can often be directed off center or in some manner so as to cause one or more of the cartridges to become misaligned or cocked in the loading device. Since these devices, with few exceptions, depend upon the forces of gravity to carry the cartridges into the revolver's cylinder chambers, such cartridge cocking can result in cartridge recapture by the loading device when the releasing force is relaxed. The net result is that one or more of the revolver's cylinder chambers might not receive a cartridge.

The device shown in the Fordham et al. U.S. Pat. No. 3,541,716 presents at least a partial solution to the cartridge cocking problem by using a release mechanism that positively urges the cartridges slightly past a retaining O-ring; hence, even when some force is applied off center or in some other manner so as to cause one or more of the cartridges to become tilted or cocked, they cannot become re-engaged by the O-ring holding means when the force is relaxed. However, the remainder of the cartridge expulsion still depends upon the forces of gravity and, hence, the problem is not fully resolved.

Moreover, the solution is obtained by adopting means susceptible to premature release.

Yet another difficulty with some of the earlier devices is caused by the use of resilient washers, such as O-rings or the like, which require either a very substantial degree of flexing during operation or are adversely affected by extreme temperature vacillations and, thereby, suffer from fatigue rapidly and become inoperable.

Even though the problems of premature release, unitary construction, partial recapture of cartridges, tilted cartridges which fail to clear the holder, and other problems not stated reveal serious deficiencies in earlier devices, perhaps the most important problem common to all earlier devices is the tilting of the cartridges in the holder which make cartridge entry into the revolver's cylinder chambers difficult and, thereby consumes precious time.

Each of the earlier devices retains cartridges in the holder by clamping the flanges of the cartridges in various ways. Since the mass of each cartridge is not given lateral support, each cartridge is urged or permitted to tilt away from the center of its chamber. Rapid delivery of a round from the cartridge holder to the revolver's cylinder chamber requires not only registration with the spatial alignment of the cylinders, but also with the angle of entry. Cartridge tilt within the cartridge holder operates to diminish either one of these relationships or both. Moreover, the absence of lateral support increases the ability of an external force to tilt a cartridge in its holder chamber or to dislodge the cartridge from the holder.

U.S. Pat. No. 4,065,868, entitled Revolver Speed Loader, issued to David A. Johnson on Jan. 3, 1978, teaches a holder for releasable securement of cartridges in condition for simultaneous loading of the cartridges into the chambers of a revolver's cylinder. The holder includes a cylindrical body having a plurality of axially extending, radially distributed cartridge-receiving bores adapted to align with and introduce the rounds into the revolver's cylinder chambers. The holder also includes a manually operated cartridge engagement member for axial and rotary movement within the holder body centrally of the bores and having a double star sprocket system whose lateral projections releasably lock each cartridge flange while laterally supporting each cartridge body within the holder in a position of parallelism with a center bore. The holder further includes protected mechanism for releasing the double star sprocket system and thereby releasing the cartridges, when the cartridge ends are in the revolver's cylinder chambers, in response to the pressing of the holder against the rear of the revolver cylinder.

SUMMARY OF THE INVENTION

In view of the foregoing factors and conditions characteristic of the prior art it is an object of the present invention to provide a rapid loading device for a revolver which a person may load with one hand rather than both his hands.

It is another object of the present invention to provide a rapid loading device for a revolver which provides a resilient impetus for each cartridge thereby forcing it into its proper chamber of the cylinder of the revolver.

It is still another object of the present invention to provide a rapid loading device for a revolver.

In accordance with the preferred embodiment of the present invention a rapid loading device for a revolver which provides releasable securement of cartridges in condition for simultaneous loading of the cartridges in the chambers of the cylinder of the revolver is described. The rapid loading device includes a first cylindrical member having an open end and a closed end which forms its base and a first disc having a center bore and a plurality of axially extending, radially distributed cartridge-receiving bores adapted to align with and introduce the cartridges into the chambers of the cylinder of the revolver. The first disc is disposed within the first cylindrical member and is mechanically coupled to the inner sidewall thereof. The rapid loading device also includes a star sprocket whose lateral projections releasably lock each cartridge flange while laterally supporting each cartridge in conjunction with the first disc and a mechanism for releasing the star sprocket system in order to release the cartridges when the cartridge ends are in the chambers of the cylinder of the revolver. The mechanism includes a second cylindrical member which fits concentrically within the first cylindrical member and which has an open end which is adjacent to the open end of the first cylindrical member and a closed end which has a plurality of bores which are aligned with the bores of the first disc, a spring means for resiliently biasing the second cylindrical members in relation to the first cylindrical member and a coupling device for rotating the star sprocket in response to the second cylindrical member being pressed into the first cylindrical member.

The features of the present invention which are believed to be novel are set forth with particularity in the appended claims.

Other objects and many of the attendant advantages will be more readily appreciated as the same becomes better understood by reference to the following detailed description and considered in connection with the accompanying drawing in which like reference symbols designate like parts throughout the figures.

DESCRIPTION OF THE DRAWING

FIG. 1 is a perspective view of an improved rapid loading device for revolvers which has been constructed in accordance with the principles of the present invention.

FIG. 2 is a plan view of the improved rapid loading device of FIG. 1.

FIG. 3 is a cross-sectional, elevational view of the rapid loading device of FIG. 1 taken along line 3—3 of FIG. 2.

FIG. 4 is a cross-sectional, elevational view of the improved rapid loading device of FIG. 1 shown in its operating mode.

FIG. 5 is a cross-sectional, plan view of the improved rapid loading device of FIG. 1 showing the star sprocket system thereof.

DESCRIPTION OF THE PREFERRED EMBODIMENT

In order to best understand the present invention it is necessary to read the foregoing description of the preferred embodiment in conjunction with the accompanying drawing. Referring to FIG. 1 the present invention is a rapid loading device 10 for a revolver which provides releasable securement of cartridges in condition for simultaneous loading of the cartridges in the chambers of the cylinder of the revolver. The rapid loading device 10 includes a first cylindrical member 11 having an open end and a closed end which forms the base of the rapid loading device 10 and a second cylindrical member 12 which fits concentrically and snugly within the first cylindrical member 11 and which has an open end which is adjacent to the open end of the first cylindrical member 11 and a closed end which has a plurality of axially extending, radially distributed cartridge-receiving bores adapted to align with and introduce the cartridges into the chambers of the cylinder of the revolver.

Referring to FIG. 2 in conjunction with FIG. 3 the rapid loading device 10 also includes a first disc 21 having a center bore and a plurality of bores which are aligned with the plurality of bores in the second cylindrical member 12. The first disc 21 is disposed within the first cylindrical member 11 and is mechanically coupled to the inner sidewall thereof.

The rapid loading device 10 further includes a spring 22 for resiliently biasing the second cylindrical member 12 in relation to said first cylindrical member 11, a star sprocket 23 and a rectangular rod 24 for rotating the star sprocket 23 in response to the second cylindrical member 12 being pressed into the first cylindrical member 11. The spring 22 is mechanically coupled to the first disc 21 and the closed end of the second cylindrical member 12 is axially aligned with the center bore of the first disc 21. The star sprocket 23 has lateral projections which releasably lock each cartridge flange while laterally supporting each cartridge in conjunction with the first disc 21. The rectangular rod 24 rotates the star sprocket 23 in order to release the cartridges when the cartridge ends are in the chambers of the cylinder of the revolver. The rectangular rod 24 is twisted so that its ends are approximately thirty degrees out of alignment with each other and is fixedly coupled to the star sprocket 23 at one of its ends. The rapid loading device 10 still further includes a coupling device 25 which is fixedly coupled to the closed end of the second cylindrical member 12 and which is slidably coupled to the rectangular rod 24.

Still referring to FIG. 3 the rapid loading device 10 still further includes a plurality of pads 26 on which the ends of the cartridges rest. Each of the plurality of pads 26 is aligned with one of the plurality of bores in the second cylindrical member 12 and a plurality of springs 27, each of which is mechanically coupled to one of the plurality of pads 26.

Referring now to FIG. 4 in conjunction with FIG. 5 the second cylindrical member 12 is pressed into the first cylindrical member 11 thereby causing the coupling device 25 to rotate the twisted rectangular rod 24 thereby rotating the star sprocket 23. The rotation of the star sprocket 23 releases the flanges of the cartridges each of which one of the plurality of springs 27 propels into one of the chambers of the cylinders of the revolver.

From the foregoing it can be seen that a rapid loading device for a revolver has been described. The advantage of the rapid loading device is that a user of a revolver can reload it using only one hand rather than two hands as are required for the prior art rapid loading device.

Accordingly it is intended that the foregoing disclosure and showing made in the drawing shall be considered only as an illustration of the present invention. Furthermore, it should be noted that the sketches are not drawn to scale and that distances of and between the various figures are not to be considered significant. The invention will be set forth with particularity in the appended claims.

What is claimed is:

1. A rapid loading device for a revolver which provides releasable securement of cartridges in condition for simultaneous loading of the cartridges in the chambers of the cylinder of the revolver, said rapid loading device comprising:

a. a first cylindrical member having an open end and a closed end which forms the base of said rapid loading device;

b. a first disc having a center bore and a plurality of axially extending, radially distributed cartridge-receiving bores adapted to align with and introduce the cartridges into the chambers of the cylinder of the revolver, said first disc is disposed within said first cylindrical member and is mechanically coupled to the inner sidewall thereof;

c. a star sprocket whose lateral projections releasably lock each cartridge flange while laterally supporting each cartridge in conjunction with said first disc; and d. means for releasing said star sprocket system in order to release the cartridges when the cartridge ends are in the chambers of the cylinder of the revolver.

2. A rapid loading device according to claim 1 wherein said means for releasing said star sprocket system comprises:

a. a second cylindrical member which fits concentrically and snugly within said first cylindrical member and which has an open end which is adjacent to the open end of said first cylindrical member and a closed end which has a plurality of bores which are aligned with said plurality of bores of said first disc;

b. spring means for resiliently biasing said second cylindrical member in relation to said first cylindrical member; and c. rotating means for rotating said star sprocket in response to said second cylindrical member being pressed into said first cylindrical member.

3. A rapid loading device according to claim 2 wherein said spring means comprises a spring which is mechanically coupled to said first disc and the closed end of said first cylindrical member and which is axially aligned with said center bore of said first disc.

4. A rapid loading device according to claim 3 wherein said rotating means comprises:

a. a rectangular rod which is twisted so that its ends are approximately thirty degrees out of alignment with each other, said rectangular rod is fixedly coupled to said star sprocket at one of its ends; and b. a device which is fixedly coupled to the closed end of said second cylindrical member and which is slidably coupled to said rectangular rod.

5. A rapid loading device according to claim 4 wherein said rapid loading device also comprises:

a. a plurality of pads on which the ends of the cartridges rest, each of said plurality of pads is aligned with one of said plurality of bores in said first disc; and b. a plurality of springs, each of which is mechanically coupled to one of said plurality of pads.

* * * * *